US005551088A

United States Patent [19]

Stepp

[11] Patent Number: 5,551,088

[45] Date of Patent: Sep. 3, 1996

[54] SHAMPOO SHIELD

[76] Inventor: Sharon Stepp, P.O. Box 435, Lake Villa, Ill. 60046

[21] Appl. No.: 410,696

[22] Filed: Mar. 27, 1995

[51] Int. Cl.[6] ..... A42B 1/06

[52] U.S. Cl. ..... 2/174; 4/521

[58] Field of Search ..... 2/50, 174, 171; 4/521; 132/212

[56] References Cited

U.S. PATENT DOCUMENTS

| | | | |
|---|---|---|---|
| 835,814 | 11/1906 | Dalton | 4/521 |
| 2,629,870 | 3/1953 | Hudson | 2/174 |
| 3,235,882 | 2/1966 | Coleman | 2/174 |
| 3,996,946 | 12/1976 | Craig | 132/212 |
| 5,099,865 | 3/1992 | Flannery et al. | 2/174 |
| 5,146,629 | 9/1992 | Barnes | 2/174 |

*Primary Examiner*—Diana Biefeld
*Attorney, Agent, or Firm*—Paul H. Gallagher

[57] ABSTRACT

A single sheet of plastic material having a head opening notch at a front end, thus forming horns at the sides, the horns having free ends directed inwardly toward each. Detachable securing patches are applied ought he free ends of the horns. The side edges of the sheet, at the rear end, are folded over and stitched together, forming a tube. The horns are detachable applied to the head of the patron, forming a channel leading rearwardly to the tube.

4 Claims, 2 Drawing Sheets

SHAMPOO SHIELD

SUMMARY OF THE INVENTION

The invention relates to a shield used in shampooing. A broad object of the invention is to provide such a shield that can be applied to the patron to enable the patron to sit in a straight upright position, and her hair rinsed, and the rinse water is carried off to a receptacle without any overflowing onto her body.

Another object of the invention is to provide such a shield that is extremely simple in construction, being made essentially of a single plastic sheet.

Another object is to provide such a shield that includes a novel adjustability feature such that a single such shield can be effectively used with different sized heads.

An additional feature of the device is that the plastic sheet is shaped to form an open channel surrounding the head for receiving the rinse water, and it is shaped at the rear to form a funnel leading into a closed tubular section to carry the rinse water from the channel to a receptacle. The closed tubular section additionally provides strength to the open channel maintaining it in shape, and to the article.

DETAIL DESCRIPTION OF THE INDIVIDUAL FIGURES OF THE DRAWINGS

DETAILED DESCRIPTION OF THE DRAWINGS

Figure 2:
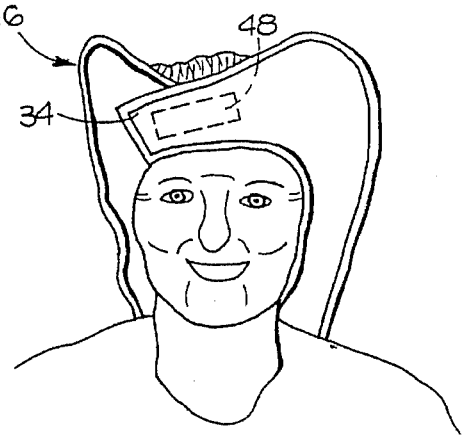
FIG. 2 is a front view.
Figure 1:
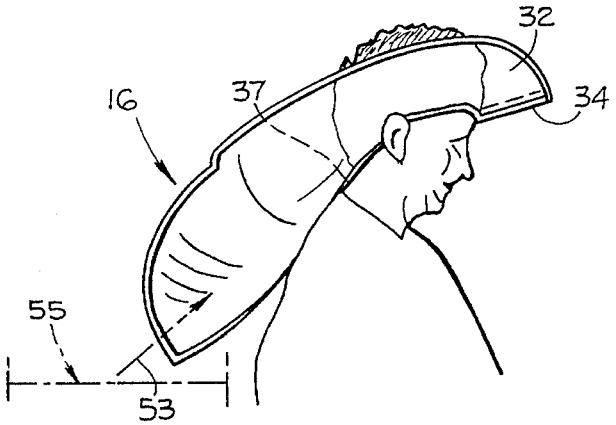
FIG. 1 is a side view of the shampoo shield of the invention.
Figure 3:
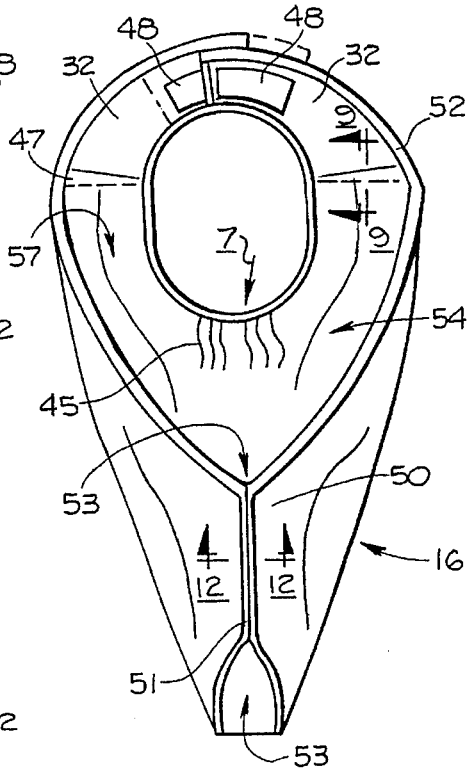
FIG. 3 is a top view.

FIGS. 1, 2, and 3 show the side, front, and top of the shampoo shield, these views showing its overall character, and its position in place when in use, and indicates its overall function. However to fully explain its nature and function, the following includes first a description of the detail construction of the article. The article, or shampoo shield, consists basically of a single sheet, with additional functional elements of an elastic band at one location and detachable connector pieces at another location. It also includes a binding for appearance sake which does not enter into the functioning of the device.

Figure 4:
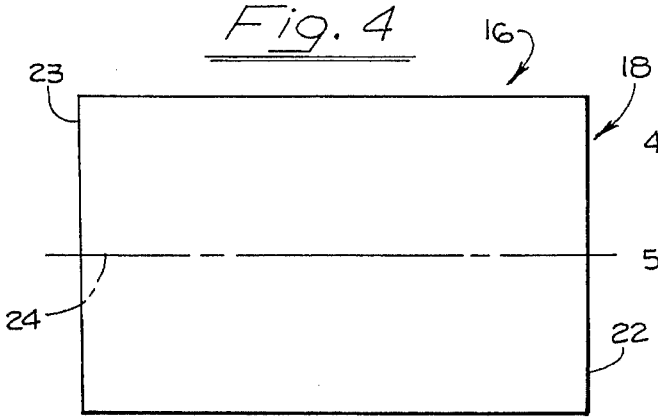
FIG. 4 shows a single piece cut from a single flat sheet, which when folded and otherwise shaped, forms the entire article.

The shampoo shield is indicated in its entirety at 16, and FIG. 4 shows a flat piece of material 18 which makes up nearly the entire article. The material of the sheet is preferably plastic, but not limited thereto, so long as it is impervious to water. One example of the plastic material that has been found satisfactory is plastic sheeting put out by Polar Plastic, of approximately 6 mil in thickness. This material is sufficiently thick and strong to be utilized in a single sheet. It is bendable and pliable, but strong, in the shaping of the article, providing great strength in the resulting elements of the constructed shield, as will be referred to again in detail hereinbelow.

Figure 5:
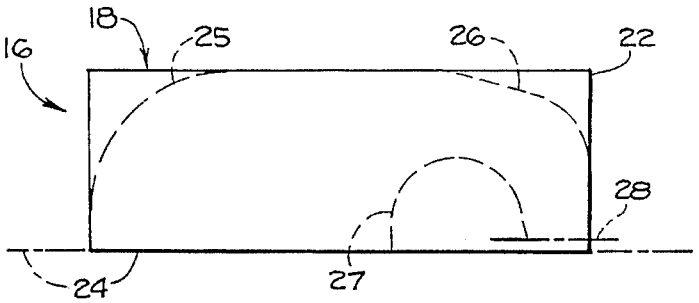
FIG. 5 is a view of the sheet of FIG. 4 in folded condition, preparatory to cutting it for shaping.

The single piece shown in FIG. 4, that is to make up nearly the entire article 16, has an upper or front end 22 and a lower or rear end 23. The piece 18 is cut off from a continuous large sheet of aggregate material. In shaping the piece, it is first folded on a center axis line 24, and then the doubled sheet is cut (FIG. 5) on the curved dot-dash lines 25, 26 at the loose edge corners of the doubled sheet; on the curved dot-dash line 27 at the double, folded edge 24; and on the dot-dash line 28 adjacent to but above the folded edge 24.

Figure 6:
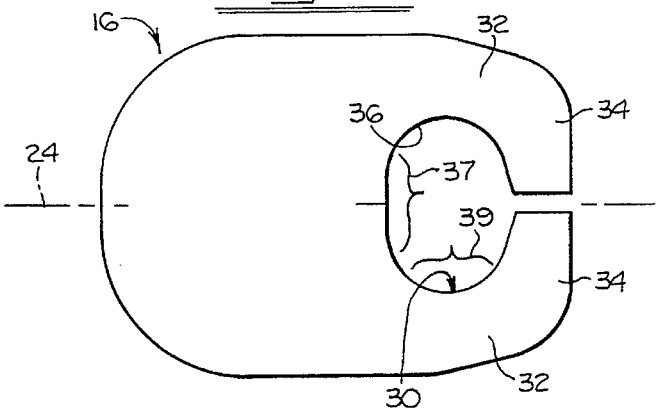
FIG. 6 shows the sheet flattened out, after shaping.

The sheet after being thus cut, and being flattened out, appears as in FIG. 6, having a head opening or large notch 30 bounded on the sides by horns 32, the horns having free end tabs 34 terminating near the center line 24. The sheet also has outer peripheral shapes corresponding to the curved lines 25, 26.

Figure 7:
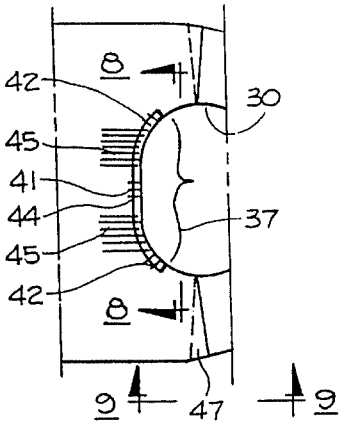
FIG. 7 is a fragmentary view of a portion of the article taken approximately in the area indicated by the arrow 7 in FIG. 3.
Figure 8:
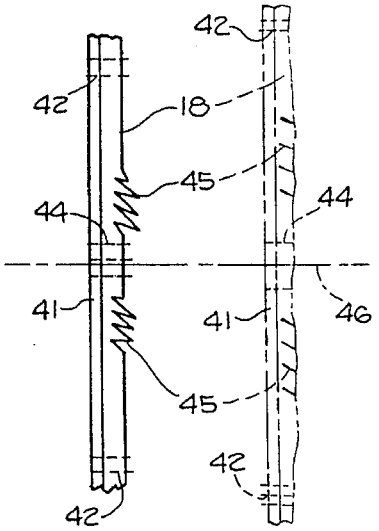
FIG. 8 is a view taken at line 8—8 of FIG. 7, in contracted condition in full lines and in stretched condition in dot-dash lines.
Figure 11:
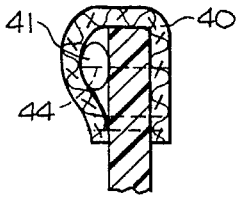
FIG. 11 is a sectional view taken at line 11—11 of FIG. 10.
Figure 9:
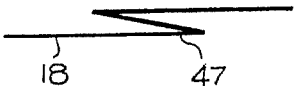
FIG. 9 is a view taken at line 9—9 of FIG. 7.
Figure 12:
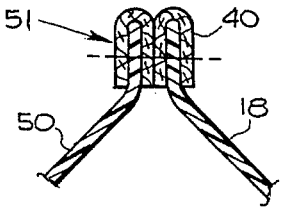
FIG. 12 is a view taken at line 12—12 of FIG. 3.

The head opening has an inner edge 36 which includes a nape section 37 and side sections 39 defined by the horns. An elastic band 41 is applied to the nape section 37 (FIGS. 7, 11), secured at its ends to the sheet, by stitching 42, and at intermediate points by stitching 44, where pleats 45 are formed in the sheet. The corresponding portion of the sheet is drawn up in normal condition, but is stretchable. This stretchability is represented in FIG. 8, by the two conditions, spaced apart along a center line 46.

Additional pleats 47 are formed in the horns, about midway in the length of the latter, each of inwardly converging shape.

Preferably a binding 40 of known kind is applied to the edges of the piece 18 for appearance purposes, and for protecting the pleats. It is stitched to the material of the plastic piece completely around the edge of the head opening and around the outer perimeter edge of the piece.

At the ends of the horns are securement pads 48 for detachably securing the ends of the horns together the pads may be of a well known hook/filament kind, such as Velcro pads (a trademark).

Figure 10:
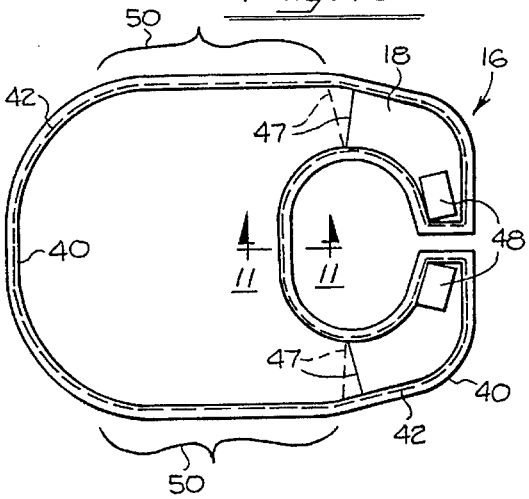
FIG. 10 is a view of the sheet of FIG. 6 with finishing pieces applied thereto.

In a final step in forming the finished article, the side edges of the piece or sheet 18, at 50 (FIG. 10) are folded over and stitched together in a seam 51 (FIG. 3) forming an enclosed tube or tubular passage or tunnel 53, and a funnel 54 leading into the tube.

In applying the shield to the head of the patron, as described hereinbelow, the nape section 37 is fitted to the back of the neck, the horns 32 are extended around the head, and the free end tabs 34 thereof become positioned at the front of the patron, or at the forehead, and they are overlapped and detachably connected together by the connector means 48.

In putting the shield to use, the patron is of course seated in front of a receptacle or bowl 55, and the lower or rear end of the device is extending into it or over it. The tubular construction at 53 provides great strength to the entire finished article. The tubular shape itself provides such strength, and in addition the peripheral edge portions at and above the tube are also drawn up, resulting in the outer peripheral edges of the horns being drawn and directed upwardly. This then results In a passage, an upwardly opening channel 57, mainly around the head and leading into the funnel 54 and thus into the tube 53. The water is then funneled through the tube 53 and to the receptacle 55. At all locations, the water in the passage or channel 54 is confined against escape, except through the tube as referred to. Thus in ordinary and reasonable use, the water does not overflow outwardly in uncontrolled fashion.

FIG. 3 indicates, in dot-dash lines, that the free ends of the horns 32 may be overlapped to greater or lesser extent. This would of course accommodate different size heads, but also in the case of a single application, the ends may be overlapped to a greater degree and the outer edges thereof would thereby extend more abruptly upwardly. As viewed in FIG. 1, the free ends of the horns, as indicated at 34 are or course inclined downwardly in rearward direction, but in particular cases it may be desired for it to be so inclined to a greater extent due for example to the condition of the hair, and in order to increase that inclination, the free ends 34 are drawn up tighter and overlapped to a greater extent, thus holding the outer peripheral edge in a higher position. Also, it may be desired a times for the operator to hold her hand below the front end to compensate for excessive flow of water.

The construction of the lower or rear portion is of great importance, which in addition to providing great strength, also confines the water more effectively against splashing or spilling or otherwise in annoying directions.

I claim:

1. A shampoo shield comprising, a single flexible, water-impervious sheet having such character as to be capable of lying in a plane, the sheet having an under surface and an upper surface, and having a front end and a rear end, the sheet having at its front end, a head opening formed by a pair of transversely spaced horns extending generally forwardly and having free end tabs turned inwardly toward each other, the sheet, at its rear portion, having side edges and an intermediate portion therebetween, the side edges being secured together in a seam at a position above said intermediate portion, thereby forming a tube defined entirely circumferentially therearound by the sheet, said seam terminating at its rear end at a position forwardly of the rear end of the sheet, thereby forming an unimpeded rear open end of the tube, said seam also terminating at its front end at a position forming an unimpeded front end of the tube that is located rearwardly of said head opening, the shield being capable of being applied to the head of a patron and when so applied, the patron's head is fitted in said opening and the free end tabs are fitted to the front of the head and overlapped, such that the top of the head is thereby exposed through the opening, and the free end tabs having counterpart securing pads thereon capable, when said free end tabs are overlapped, of interfitting and releasably securing the shield on the patron's head, the free end tabs being operable for drawing the outer peripheral edges of the horns upwardly thereby forming a channel along the front and sides of the head communicating with said tube, the free end tabs also being operable, in response to greater or less or extent of overlapping, respectively, for increasing or decreasing the tightness of the fit to the wearer's head, and increasing or decreasing the height of the outer peripheral edges of the horns, and correspondingly increasing or decreasing the depth of the channel.

2. A shampoo shield according to claim 1 wherein, said free end tabs are flat with 2-dimensional surface areas interengaging, and are capable of being fitted together with their outer peripheral edges being drawn up to different extents for correspondingly drawing up the outer peripheral edges of the horns to form respectively different depths of the channel.

3. A shampoo shield according to claim 2 wherein, the horns have, at positions intermediate their length and at the sides of the head of a patron wearing the shield, pleats formed therein converging in shape in direction leading from the outer peripheral edge of the horns inwardly toward the head of a wearer.

4. A shampoo shield according to claim 3 wherein, the outer peripheral edges of the horns continue uninterruptedly to and merge integrally into the edges of the sheet forming said seam, whereby the channel continues uninterruptedly to and merges with said tube.

* * * * *